United States Patent [19]

Shibazaki et al.

[11] Patent Number: 5,050,320

[45] Date of Patent: Sep. 24, 1991

[54] MULTI-SHAFT KNEADING AUGER SYSTEM

[75] Inventors: Mitsuhiro Shibazaki, Tokyo; Tsutao Takahashi, Kanagawa, both of Japan

[73] Assignees: Kajima Corporation; Chemical Grouting Co., Ltd., both of Japan

[21] Appl. No.: 424,987

[22] Filed: Oct. 23, 1989

[30] Foreign Application Priority Data

Oct. 26, 1988 [JP] Japan ..... 63-138669[U]
Oct. 26, 1988 [JP] Japan ..... 63-268226

[51] Int. Cl.[5] ..... E02F 5/04

[52] U.S. Cl. ..... 37/81; 37/189; 405/267; 175/55; 175/171

[58] Field of Search ..... 405/267, 266, 232, 233, 405/240, 241, 242, 243, 253; 175/173, 195, 394, 51, 55, 171; 37/81, 189

[56] References Cited

U.S. PATENT DOCUMENTS

| | | | |
|---|---|---|---|
| 2,553,541 | 5/1951 | Bodine, Jr. | 175/55 X |
| 3,969,902 | 7/1976 | Ichise et al. | 405/266 X |
| 4,148,367 | 4/1979 | Reich | 175/171 |
| 4,886,400 | 12/1989 | Taki et al. | 405/233 X |

*Primary Examiner*—Dennis L. Taylor

*Assistant Examiner*—J. Russell McBee

*Attorney, Agent, or Firm*—Beveridge, DeGrandi & Weilacher

[57] ABSTRACT

The present invention relates to a multi-shaft kneading auger system having a plurality of kneading shafts or rotating shafts used to form a continuous wall in the ground. Grouting blades driven by chains, are positioned near the lower ends of the kneading shafts. A grouting edge of the blade forms a predetermined angle with the surface of the kneading shafts. Also, a scraping apparatus is formed in a part of the rotating shafts. The scraping apparatus comprises a supporting member laterally supported in the part of the rotating shafts, plain blades vertically movably supported on the supporting member and substantially located on common tangential lines of the rotational surfaces of the grouting blades, a coupling member including rollers and laterally coupling the plain blades, and cams provided in the part of the rotating shafts and adapted to engage with the rollers. Thus, a unit of the continuous wall, having a rectilinear central portion and semicircular end portions, can be dug and grouted without losing linearity of the rectilinear portion.

4 Claims, 6 Drawing Sheets

MULTI-SHAFT KNEADING AUGER SYSTEM

FIELD OF THE INVENTION

The present invention relates to a multi-shaft kneading auger system including a plurality of kneading shafts (i.e., rotating shafts) having grouting blades. The kneading or rotating shafts are used to form a continuous wall in the ground.

DESCRIPTION OF THE PRIOR ART

An original position earth mixing method has been widely used to form an earth retaining wall in the ground or a dead water wall in a sheet pile earth retaining construction or the like. This method includes the steps of: digging the ground and grouting a wall body, discharging a mixing liquid such as cement or the like from the tip of a kneading shaft, and mixing the liquid with the original position earth in the ground to thereby form a continuous wall.

FIGS. 7 and 8 show a conventional multi-shaft kneading auger system used to form such a continuous wall. A guide post 2 is vertically arranged on a self-propelled truck 1. A driving apparatus 3 is attached to the guide post 2 so as to be vertically movable. A multi-shaft apparatus 4 is coupled to the lower portion of the driving apparatus 3. A plurality of kneading or rotating shafts 5A, 5B, and 5C (sometimes generally referred to as reference numeral 5) are attached to the multi-shaft apparatus 4. The rotating directions of the shafts 5A–5C are predetermined so as to rotate in a direction opposite that of an adjacent shaft. The shafts 5A–5C are coupled by a coupling apparatus 9 which also serves as a bearing.

Grouting blades 6 are attached to the lower ends of the kneading shafts 5. A screw-shaped moving wing 7 and a rod-shaped kneading wing 8, each having the same diameter as that of the grouting blade 6, are alternatively arranged above the grouting blade 6. The tips of the adjacent kneading wings 8 cooperatively mix the original position earth and the mixing liquid, thereby forming a unit of a continuous wall. If necessary, H-shaped steels and/or sheet piles are vertically buried into the continuous wall, thereby improving the earth retaining property and the dead water property.

However, in the above-mentioned conventional multi-shaft kneading auger system, the outer kneading shafts 5A and 5C and the central kneading shaft 5B are rotated in opposite directions (i.e., adjacent shafts are rotated in opposite directions) in order to execute the mixing work. This results in the rotational reaction forces of the grouting blades 6 becoming unbalanced at a ratio of 2:1, thereby causing the unit of the continuous wall to lack linearity.

Furthermore, since it is necessary to continuously execute the grouting work so as to overlap the rotating ranges of the grouting blades 6, the distance between the kneading shafts 5 is limited In other words, as shown in FIG. 9, rotational ranges $A_1$ to $A_2$ of the grouting blades 6 are mutually overlapped, and shaded portions N remain ungrouted. Although minimizing the total area of the portions N is desirable, the distance between the shafts 5 cannot be set to a value equal to or larger than a predetermined limit value because the total area of the portions N increases as the distance between the rotating shafts 5 increases. Consequently, the grouting performance of the above-mentioned conventional auger system is limited.

As further shown in FIG. 9, when reinforcing by vertically burying an H-shaped steel H: or H2, the H-shaped steel must be inserted along the shaft line of the rotating shaft 5. This type of insertion limits the position in which the H-shaped steel can be vertically buried.

SUMMARY OF THE INVENTION

An objective of the present invention is to provide a multi-shaft kneading auger system which can form a continuous wall having good linearity, which does not limit the vertical burying position of an H-shaped steel, and which can provide a relatively large distance between kneading shafts.

The multi-shaft kneading auger system of the present invention has a plurality of kneading shafts which are used to form a continuous wall in the ground. Grouting blades, driven by chains, are provided near lower ends of the kneading shafts. Grouting edges are formed on the blades at a predetermined angle with the surface of the kneading shafts.

Although preferably positioned at the lower ends of the kneading shafts, the grouting blades can also be arranged near or proximate the lower ends of the kneading shafts depending on the grouting condition of the continuous hole. Also, the chains can be driven by any one of the kneading shafts.

The multi-shaft kneading auger system of the present invention also has a scraping apparatus provided in a part of the rotating shafts. The scraping apparatus comprises a supporting member laterally supported on part of the rotating shafts and plain blades vertically and movably supported on the supporting member. The plain blades are substantially located on common tangential lines with the rotational surfaces of the grouting blades. A coupling member, including rollers, laterally couples the plain blades to each other, and cams, provided on the rotating shafts, come into engagement with the rollers.

Preferably, the part of the rotating shafts is separately constructed from the other parts, upper and lower end portions of the part are respectively coupled with the other parts of the rotating shafts or grouting blade portions through joint means, and at least two rotating shafts are used as driving shafts and the others are used as supporting shafts. Also, preferably a return spring is arranged between the supporting member and the plain blades.

In operation of the multi-shaft kneading auger system of the present invention, the kneading shafts are rotated and one of the kneading shafts drives the chains to circulatingly move the grouting blades. The grouting blades dig and grout the earth within their circulating range and form one unit of the continuous wall. The moving (i.e., circulating) direction of the grouting blades moved by each chain is a single direction, and the direction of the rotation reaction forces applied to the grouting blades is also a single direction. Thus, the rotational reaction forces are balanced as a whole so that the unit of the continuous wall is continuously and rectilinearly formed.

Furthermore, in the multi-shaft kneading auger system of the present invention, the cams are rotated by the rotating shafts and come into contact with the rollers. Through the rollers and coupling member, the plane blades vertically move. That is, the rollers function as cam followers and convert the rotation of the cams into vertical motion (i.e., reciprocation). Thus, the plain blades scrape down the earth between the rotational surfaces of the grouting blades and the common forming an elongate-shaped hole.

DETAILED DESCRIPTION OF THE PREFERRED EMBODIMENTS

Figure 1:
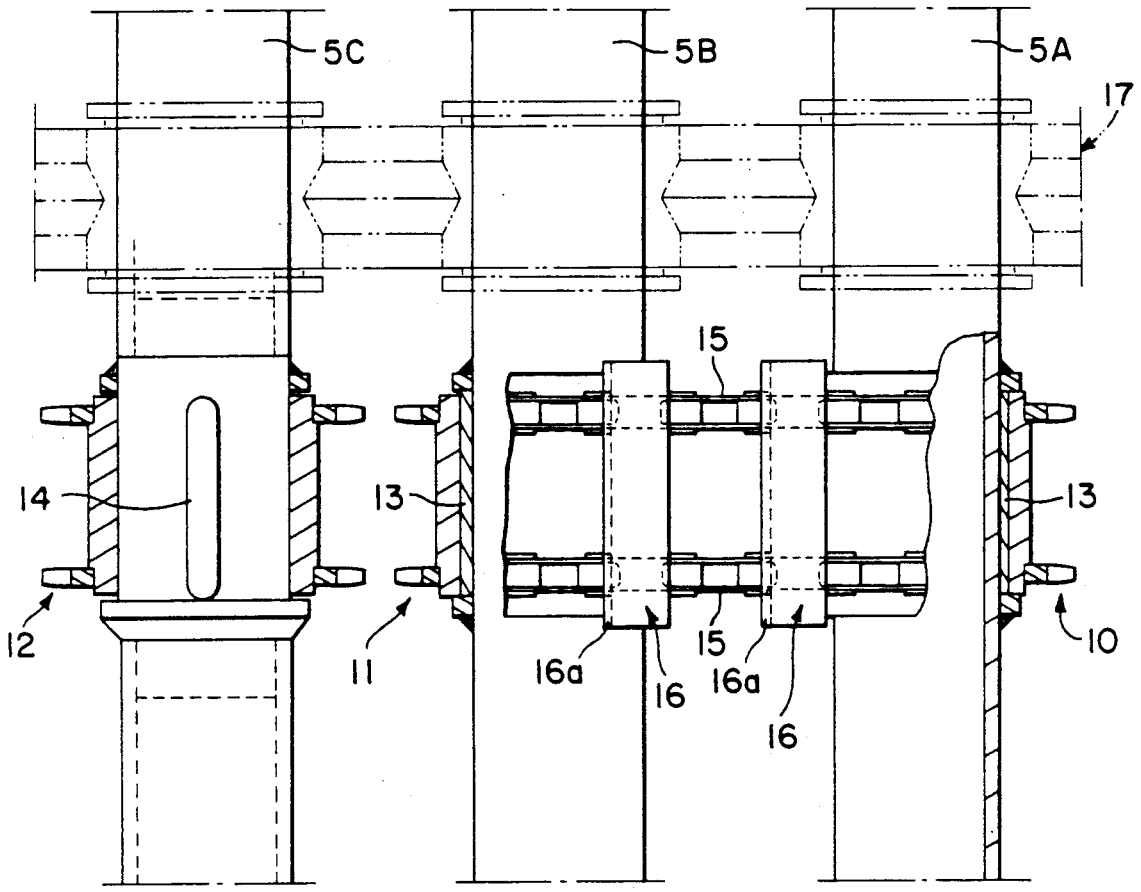
FIG. 1 is a front view showing a main section of a multi-shaft kneading auger system according to the present invention.

FIG. 1 shows an auger system including three kneading shafts 5A, 5B, and 5C coupled by a coupling apparatus 17. The coupling apparatus 17 serves as a bearing and keeps a predetermined distance between neighboring shafts.

Figure 3:
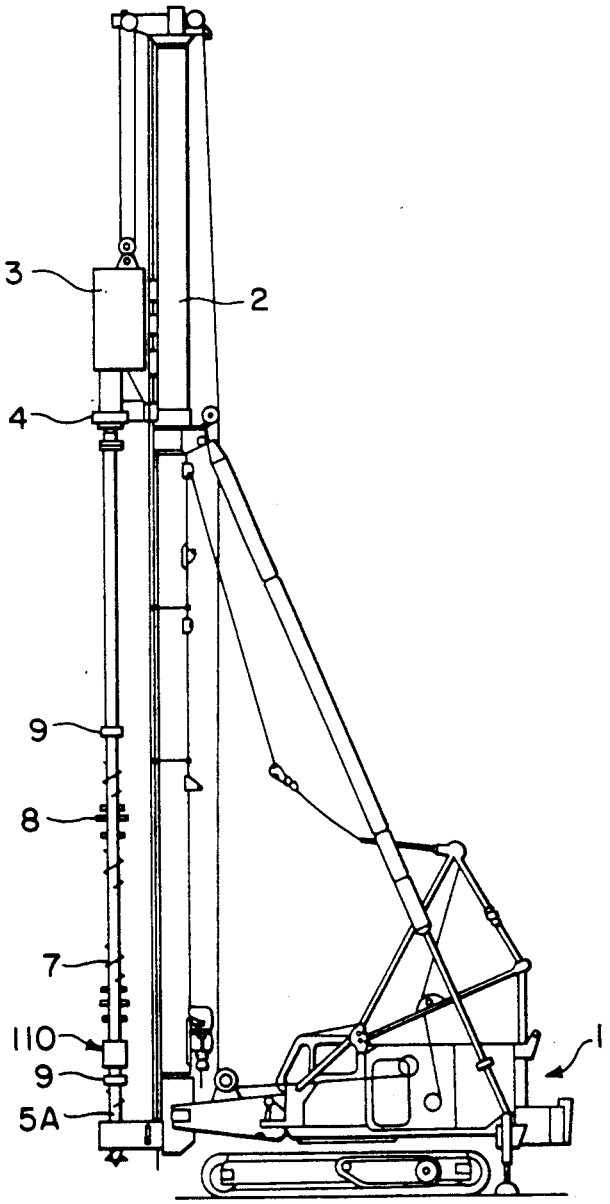
FIG. 3 is a side elevational view showing the multi-shaft kneading auger system according to the present invention.

The shafts 5A and 5C are rotated in a clockwise direction and the shaft 5B is rotated in a counterclockwise direction by a multi-shaft apparatus 4 shown in FIG. 3. Driven sprockets 10 and 11 and driving sprocket 12 are provided with upper and lower tooth portions and are positioned just under the coupling apparatus 17.

Boss portions of the driven sprockets 10 and 11 are rotatably supported (i.e., can freely race) on the kneading shafts 5A and 5B by means of metals 13. On the other hand, a boss portion of the driving sprocket 12 is fixedly supported on the kneading shaft 5C by a key 14.

Chains 15 are wound around the sprockets 10 and 12. Grouting blades 16, having blade portions **16*a*** in the vertical direction, are fixed to the outer peripheries of the chains.

Preferably, the grouting blades 16 are positioned at the lower ends of the kneading shafts 5. However, the grouting blades 16 can be also arranged at various locations near the lower ends of the kneading shafts 5, depending upon grouting conditions of the continuous hole.

Figure 2:
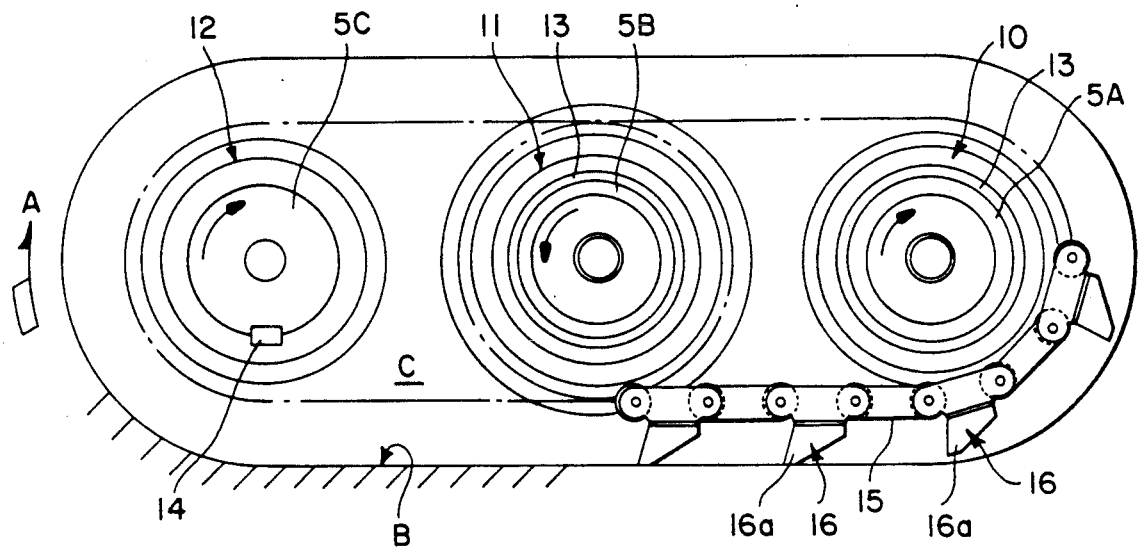
FIG. 2 is a plan view of the main section shown in FIG. 1.

Referring to FIG. 2, in digging and grouting a continuous hole, the kneading shafts 5A and 5C are rotated in the direction indicated by the arrow. The kneading shaft 5C drives the driving sprocket 12 which in turn drives the chains 15. Since the driven sprockets 10 and 11 are rotatably supported on the kneading shafts 5A and 5B, the driven sprockets 10 and 11 race with respect to the kneading shafts 5A and 5B, and the grouting blades 16 circulating move in the direction of arrow A together with the chains 15. Since the rotational reaction forces are balanced, the earth is dug and grouted in a rectilinear range B without losing the linearity of the range B. Therefore, a unit C of a continuous wall, both ends of which have semicircular shapes, is formed by the circulating movement of the grouting blades 16.

Figure 4:
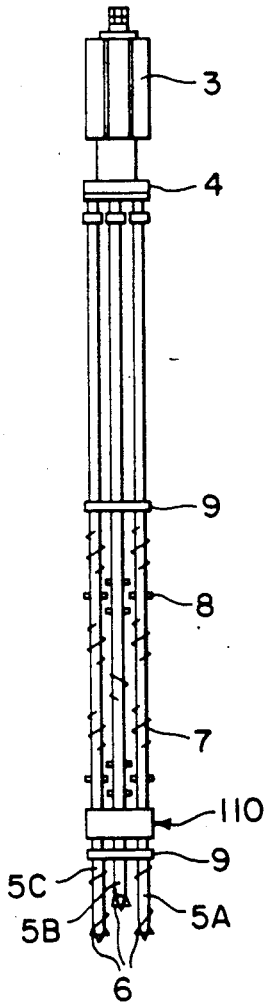
FIG. 4 is a front view showing the rotating shafts of the multi-shaft kneading auger system.

FIGS. 3 and 4 show a scraping apparatus 110 arranged on the rotating shafts 5. The scraping apparatus is positioned near the upper portions of the grouting blades 6 and just over the lower coupling apparatus 9.

Figure 5:
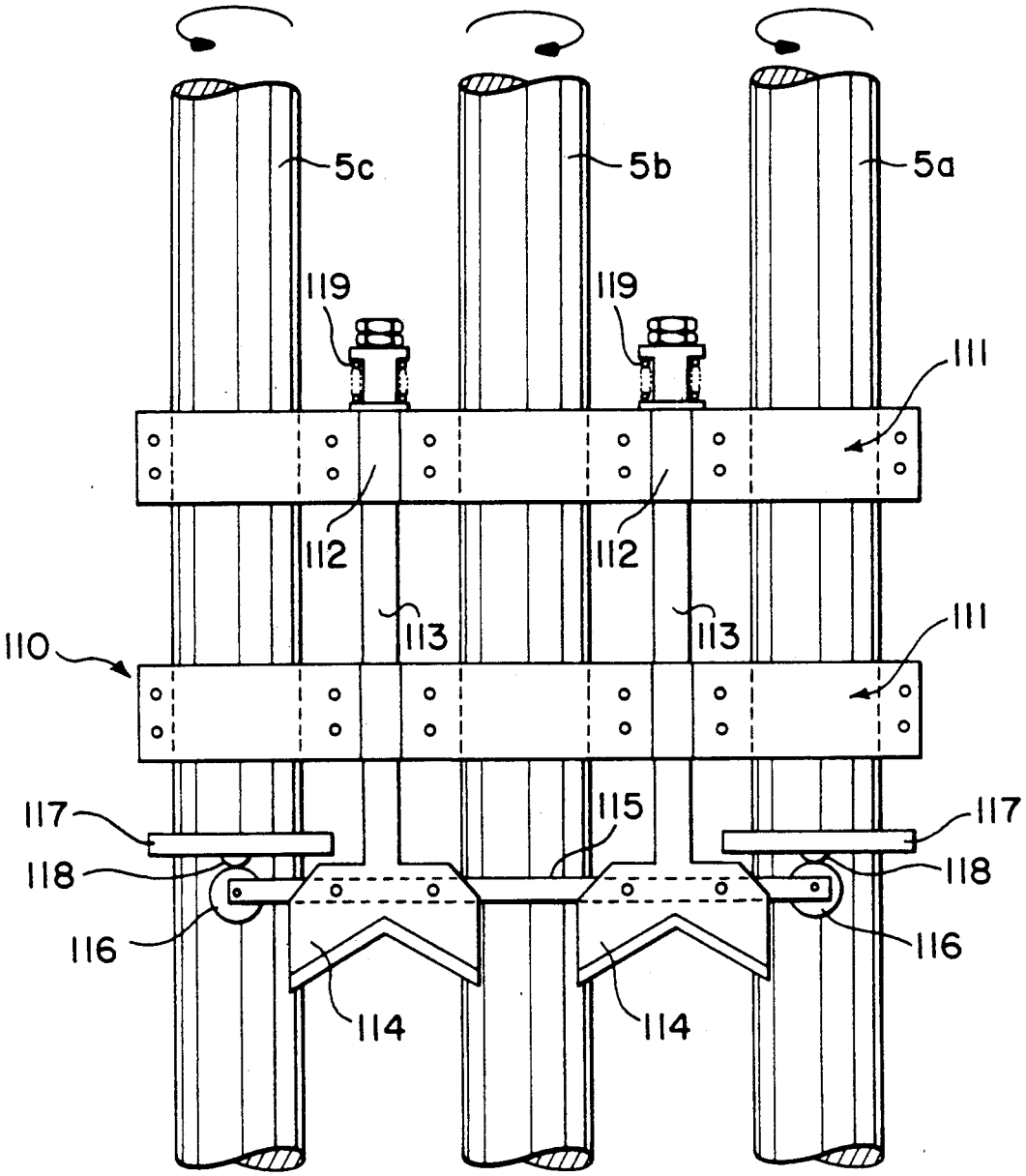
FIG. 5 is a front view showing the scraping apparatus of the multi-shaft kneading auger system.
Figure 6:
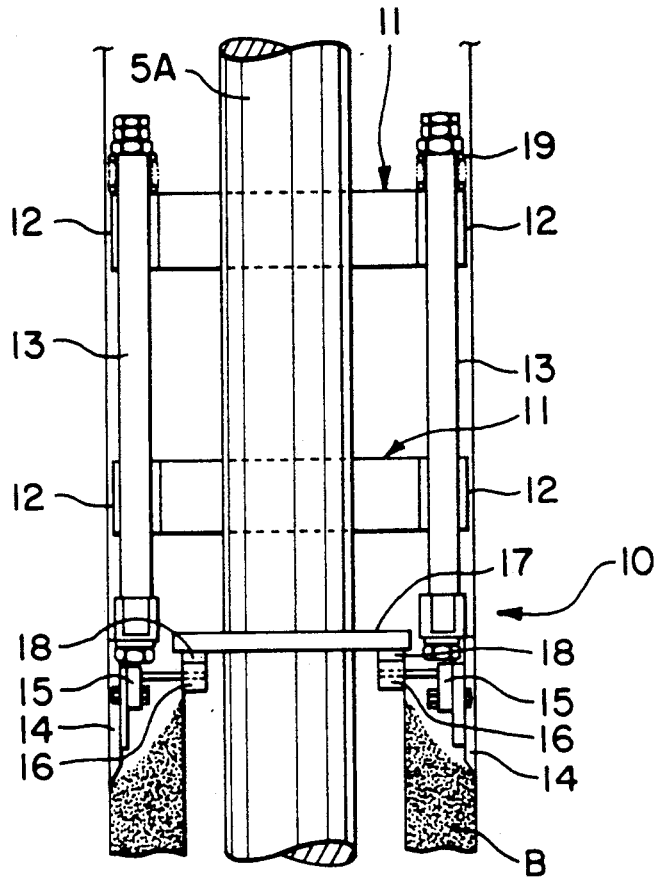
FIG. 6 is a side elevational view of the scraping apparatus shown in FIG. 5.
Figure 9:
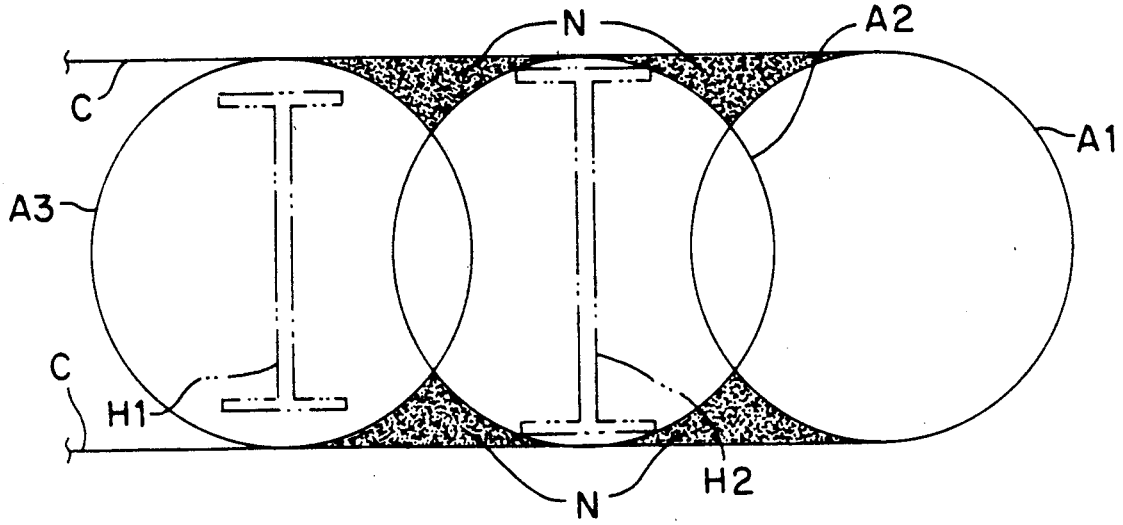
FIG. 9 is a plan view showing a grouting range.
Figure 8:
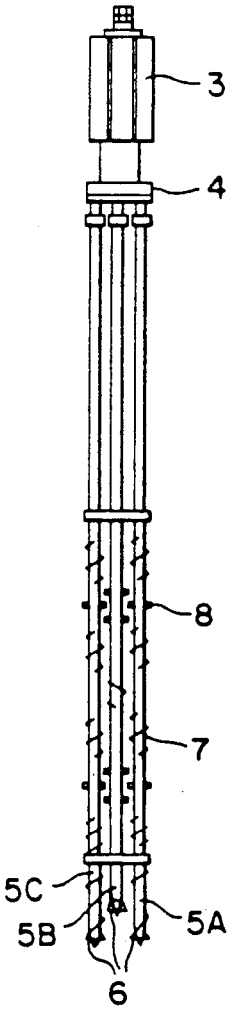
FIG. 8 is a front view showing conventional kneading shafts.
Figure 7:
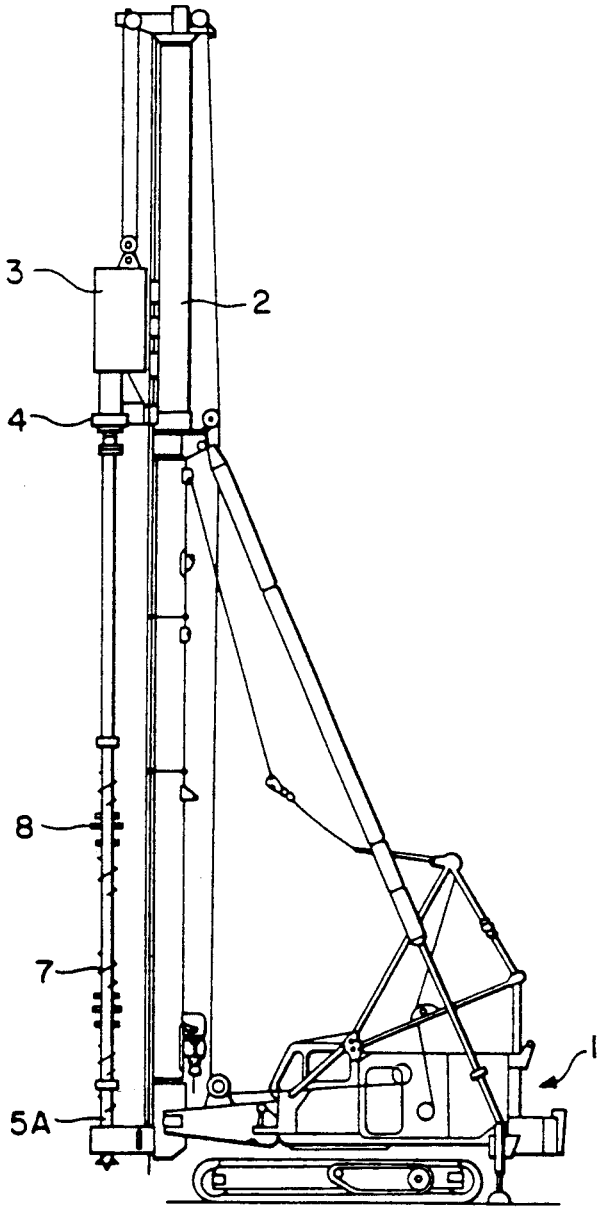
FIG. 7 is a side elevational view showing a conventional auger system.

FIGS. 5 and 6 show a detail of the scraping apparatus 110. The scraping apparatus 110 has outer drive shafts **5*a* and 5*c* and a central supporting shaft 5*b*. Upper and lower end portions of the shafts 5*a*, 5*b* and 5*c* are respectively coupled with the rotating shafts 5A, 5B, and 5C and portions of the grouting blades 6 through a joint means (not shown). Supporting brackets 111, serving as supporting members, are attached to the shafts 5*a*, 5*b* and 5*c* at the upper and lower positions. The supporting members 111 are attached such that the shafts 5*a*, 5*b* and 5*c* are rotatable but not movable in an axial (i.e., longitudinal) direction. Four boss portions 112 are formed in central portions of the supporting brackets 111 located between the shafts. Rods 113 protrude through the upper and lower boss portions 112. Plain scraping blades 114, having outer portions located on common tangential lines C (FIG. 9) of the rotational surfaces $A_1$, $A_2$, and $A_3$ of the grouting blades 6, are integrally formed at the lower ends of the rods 113. The plain blades 114 are coupled by a beam 115 serving as a coupling member and extending in a lateral direction. Both ends of the beam 115 are provided with a roller 116**, respectively.

Disks 117 are positioned above the beams 115 of the drive shafts **5*a* and 5*c*, respectively. Cams 118, for engaging with the rollers 116, are formed on the disks 117. Return springs 119 are arranged between the upper end of the rods 113 and the upper supporting bracket 111**.

When the drive shafts **5*a* and 5*c* are rotated by the rotating shafts 5A and 5C, the cams 118 come into contact with the rollers 116 and depress the plain blades 114 through depression of the rollers 116 and beams 115. When the cams 118 are removed from the rollers 116, the plain blades 114 are drawn up by operation of the return springs 119. Thus, the plain blades 114 vertically move (i.e., reciprocate) and scrape down the earth in the portions N shown in FIG. 9**.

The ground in the movement circulation range of the grouting blades is dug and grouted into a rectilinear shape having semicircular shapes at both ends, to thereby form a unit of the continuous wall. Since the direction of rotational reaction forces of the grouting blades are set to a single direction and are balanced as a whole, the rectilinear portion of the unit of the continuous wall can be rectilinearly formed. Furthermore, since the grouting blades are moved by the chains, the distance between the kneading shafts can be increased. In addition, since a rectilinear continuous hole can be formed, the limitation of position, in which an H-shaped steel is vertically buried, can be eliminated. Finally, in the case where diameters of the holes are identical, an H-shaped steel, larger than one buried in a conventional hole, can be buried.

Moreover, according to the invention, the earth between the rotational surfaces of the grouting blades and the common tangential lines of the rotational surfaces is scraped down by the vertical motions (i.e., reciprocation) of the plain blades and dug and grouted into an elongate-shaped hole. Thus, the grouting performance can be improved, and the limitation of the position at which the H-shaped steel is vertically buried can be further eliminated.

What is claimed is:

1. A multi-shaft kneading auger system comprising:

a plurality of kneading shafts for forming a continuous wall in the ground; and grouting blades positioned near the lower ends of said kneading shafts and driven to form said continuous wall, said grouting blades i.) having a grouting edge formed at a predetermined angle with the surface of said kneading shafts, and ii) being fixed to and which are driven by the movement of a chain encircling but not rigidly affixed to said kneading shafts.

2. A multi-shaft kneading auger system, comprising:

a plurality of rotating shafts having grouting blades for forming a continuous wall in the ground;

a scraping apparatus formed in a part of said rotating shafts, said scraping apparatus including:

a supporting member laterally supported in said part of said rotating shafts, plain blades movably supported on said supporting member and substantially located on common tangential lines of the rotational surfaces of said grouting blades, a coupling member laterally coupling said plain blades with each other, and cams provided in said part of said rotating shafts and adapted to engage with said coupling member, wherein said blades move up and down through the action of the cams.

3. The multi-shaft kneading auger system according to claim 1, wherein said grouting blades are positioned at the lower ends of said kneading shafts.

4. A multi-shaft kneading auger system according to claim 1 wherein said chain is driven by rotation of one or more of said kneading shafts.

* * * * *